US008726445B1

(12) United States Patent
Wagner et al.

(10) Patent No.: US 8,726,445 B1
(45) Date of Patent: May 20, 2014

(54) SHOWER-MOUNTED BACK SCRUBBER

(76) Inventors: Dennis F. Wagner, Fowler, CA (US); Laurie A. Wagner, Fowler, CA (US)

( * ) Notice: Subject to any disclaimer, the term of this patent is extended or adjusted under 35 U.S.C. 154(b) by 135 days.

(21) Appl. No.: 13/415,104

(22) Filed: Mar. 8, 2012

(51) Int. Cl.
*A47K 7/02* (2006.01)

(52) U.S. Cl.
USPC ..... 15/160; 15/210.1; 4/606

(58) Field of Classification Search
USPC ..... 15/210.1, 244.3, 244.1, 160, 15/176.1–176.5; 4/606
See application file for complete search history.

(56) References Cited

U.S. PATENT DOCUMENTS 3,078,484 A * 2/1963 Briggs ..... 15/21.1
2,294,569 A 7/1972 Enchelmaier et al.
3,961,392 A 6/1976 Young
4,053,960 A 10/1977 Kingswell
5,600,864 A 2/1997 Huber
5,779,653 A 7/1998 Thompson
5,784,722 A 7/1998 Ureta et al.
6,526,618 B1 3/2003 Bolton
6,647,564 B1 11/2003 Smith
6,662,386 B1 12/2003 Bowerman
7,062,815 B1 6/2006 Richardson
2002/0166187 A1* 11/2002 Rowe ..... 15/160
2006/0117513 A1 6/2006 Ryman
2010/0175212 A1* 7/2010 Fitzwater ..... 15/160
2011/0056038 A1 3/2011 Cooper

* cited by examiner

*Primary Examiner* — Shay Karls
(74) *Attorney, Agent, or Firm* — Robert C. Montgomery; Montgomery Patent & Design, LLC

(57) ABSTRACT

A shower-mounted back scrubber aids in scrubbing and cleaning one's back while in the shower and includes a brush surface attached to a wall of a shower or tub by at least one (1) mounting bracket. Each mounting bracket includes a slot that accepts brush base. The brush base includes a plurality of soft bristles for gentle cleansing and a coarse bristles for more aggressive cleaning.

5 Claims, 5 Drawing Sheets

SHOWER-MOUNTED BACK SCRUBBER

RELATED APPLICATIONS

Not Applicable.

FIELD OF THE INVENTION

The present invention relates generally to bathing brushes, and in particular, to a mountable back scrubbing device having removable brushes.

BACKGROUND OF THE INVENTION

The age-old problems associated with washing of one's back have never really been solved. Long-handled scrub brushes are known and are used, but they are often difficult to use and ineffective due to the fact that full back coverage or adequate scrubbing action is often not accomplished. Also when one is taking a shower, vigorous scrubbing action is difficult work and many people quickly tire of reaching behind their back. This does not even take into account the elderly or physically disabled who are incapable of cleaning their back area.

The known art also includes a variety of hydraulic or motor driven devices for scrubbing and massaging one's back area to overcome the need to manually scrub the back with the hands and arms. Many of these devices are also intended to be mounted to a shower wall for use during bathing.

However, while these known scrubbing devices may be suitable for their respective purposes, they are replete with disadvantages. Examples being the complexity of the design, the cost of replacing worn components, and the likelihood of failure of mechanical parts.

SUMMARY OF THE INVENTION

The inventor has recognized the aforementioned inherent problems and lack in the art and observed that there is a need for means by which an individual can quickly and easily cleanse, scrub, and exfoliate the back area of the body while in the shower without the disadvantages normally associated with conventional back scrubbing devices.

Accordingly, it is an object of the present embodiments of the invention to address this need by developing a shower-mountable back scrubber that is simple to install and use. Another object is to avoid the disadvantages of the known art. The inventor has thus realized the advantages and benefits of providing a shower-mountable back scrubber device having a pair of mounting brackets adapted for simple attachment to and detachment from a shower wall surface, a brush base coupled to the pair of mounting brackets, and a brush surface disposed over at least a portion of the brush base for scrubbing the skin of a bather when the bather's back is in moving contact with the brush surface.

Another object of the invention is to provide the pair of mounting brackets having a generally flat mounting plate which can be mounted to the shower wall surface by fasteners, a suction cup, or adhesives. A mounting tab extends outwardly from a front side surface of the mounting plate and a mounting slot is disposed longitudinally through the mounting tab for receiving a portion of the brush base.

Another object of the invention is to provide the brush base having an elongated and generally semi-circular base rod having a "T"-shaped protrusion extending longitudinally along an entire flat rear surface of the base rod and slidably connected within "T"-shaped mounting slots formed through the mounting brackets. A plurality of bristles is affixed to an entire curved front surface of the base rod for scrubbing the skin of a bather.

Another object of the invention is to provide the brush base having an elongated and generally circular base rod having a semi-circular top end portion and a semi-circular bottom end portion which are each slidably connected within semi-circular mounting slots formed through the mounting brackets. A disposable and replaceable tubular brush pad is removably attachable over the circular middle portion of the base rod and a plurality of bristles is affixed to an entire exterior surface of the brush pad for scrubbing the skin of a bather.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

| DESCRIPTIVE KEY | |
|---|---|
| 10 | shower-mounted back scrubber |
| 20 | mounting bracket |
| 20a | top mounting bracket |
| 20b | bottom mounting bracket |
| 21 | brush base |
| 22 | brush surface |
| 23 | mounting plate |
| 24 | mounting tab |
| 25 | mounting slot |
| 25a | top mounting slot |
| 25b | bottom mounting slot |
| 26 | open top |
| 27 | open bottom |
| 28 | closed bottom |
| 29 | base rod |
| 30 | protrusion |
| 31 | bristles |
| 32 | top end portion |
| 33 | bottom end portion |
| 34 | middle portion |
| 35 | slot cover |

-continued

| DESCRIPTIVE KEY | |
|---|---|
| 36 | fastener aperture |
| 37 | rear surface |
| 38 | suction cup aperture |
| 39 | suction cup |
| 40 | brush pad |
| 100 | shower wall |

DETAILED DESCRIPTION OF THE PREFERRED EMBODIMENT

Figure 1:
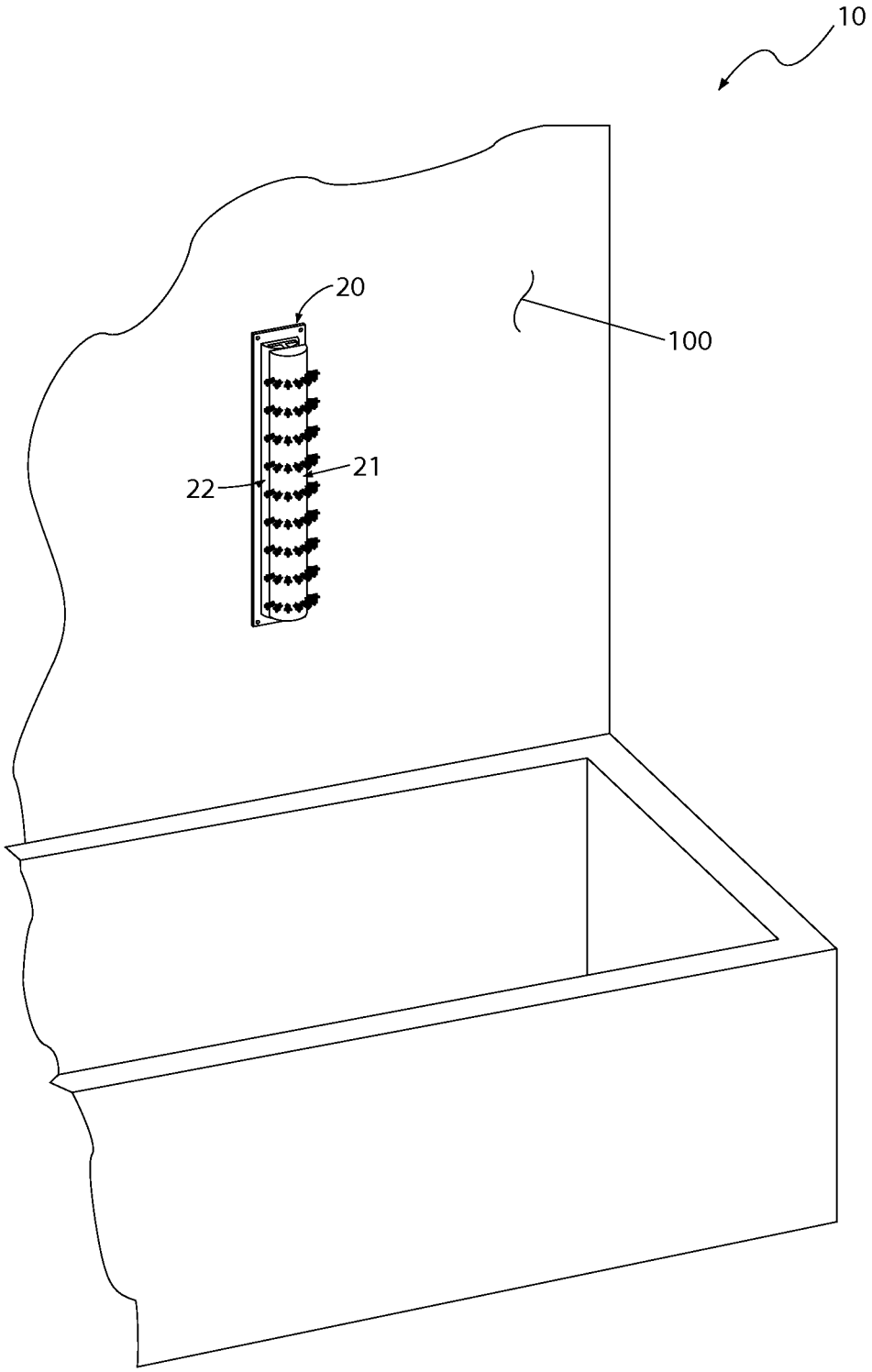
FIG. 1 is an environmental view of a shower-mounted back scrubber depicted as mounted to a shower wall surface, in accordance with the present invention.
Figure 2:
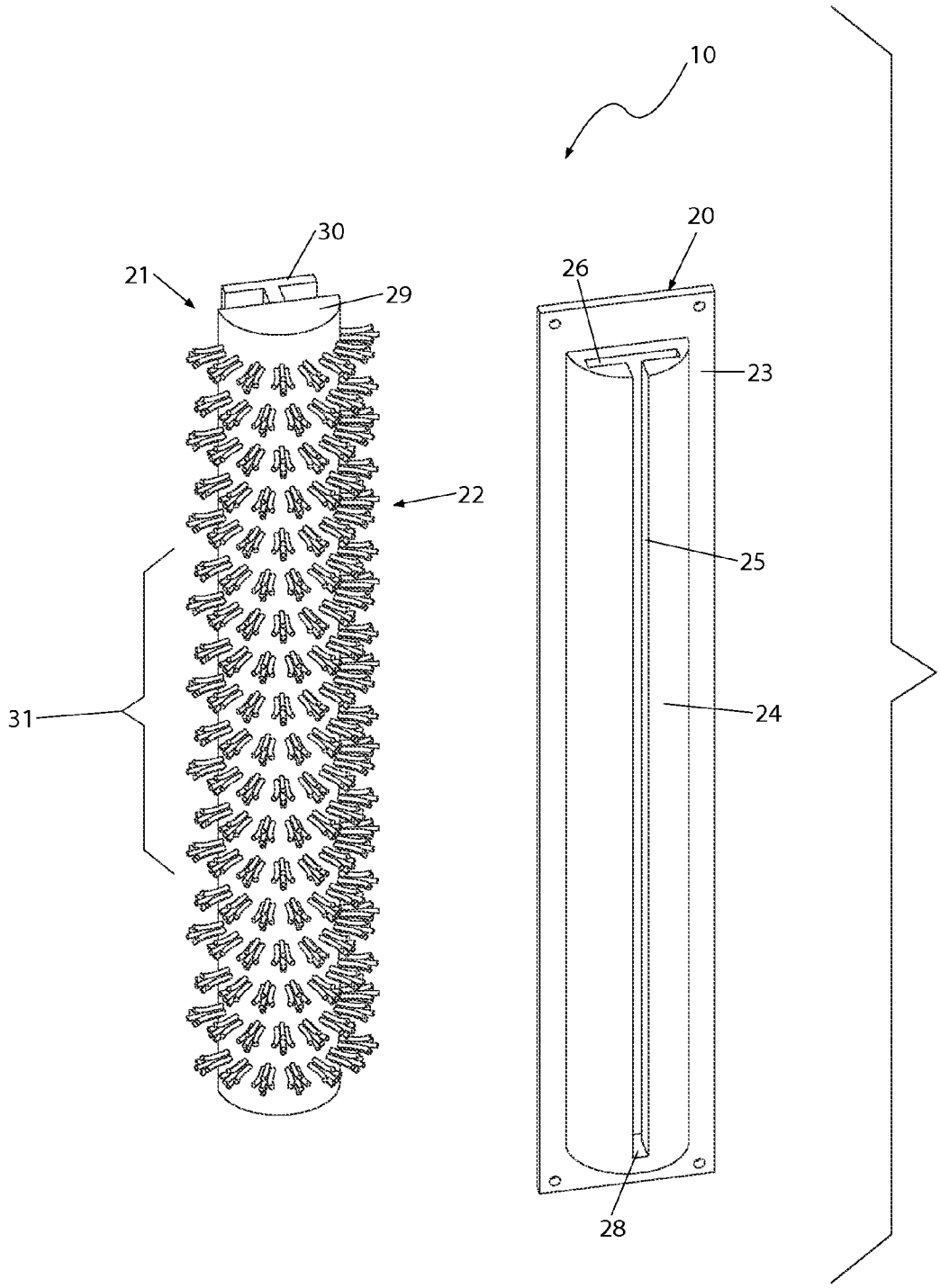
FIG. 2 is an exploded perspective view of the shower-mounted back scrubber.
Figure 3:
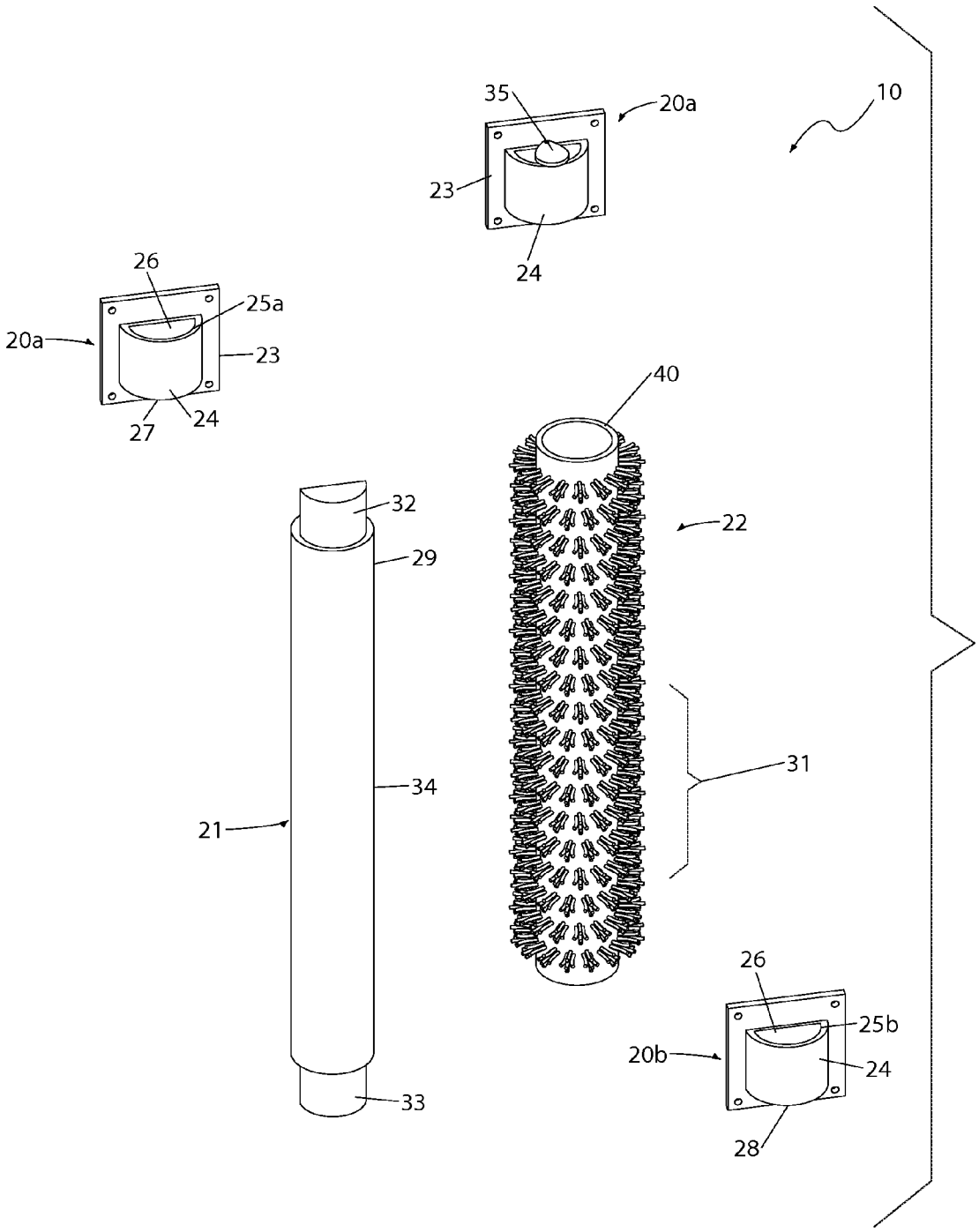
FIG. 3 is an exploded perspective view of an alternate embodiment of the shower-mounted back scrubber.
Figure 4:
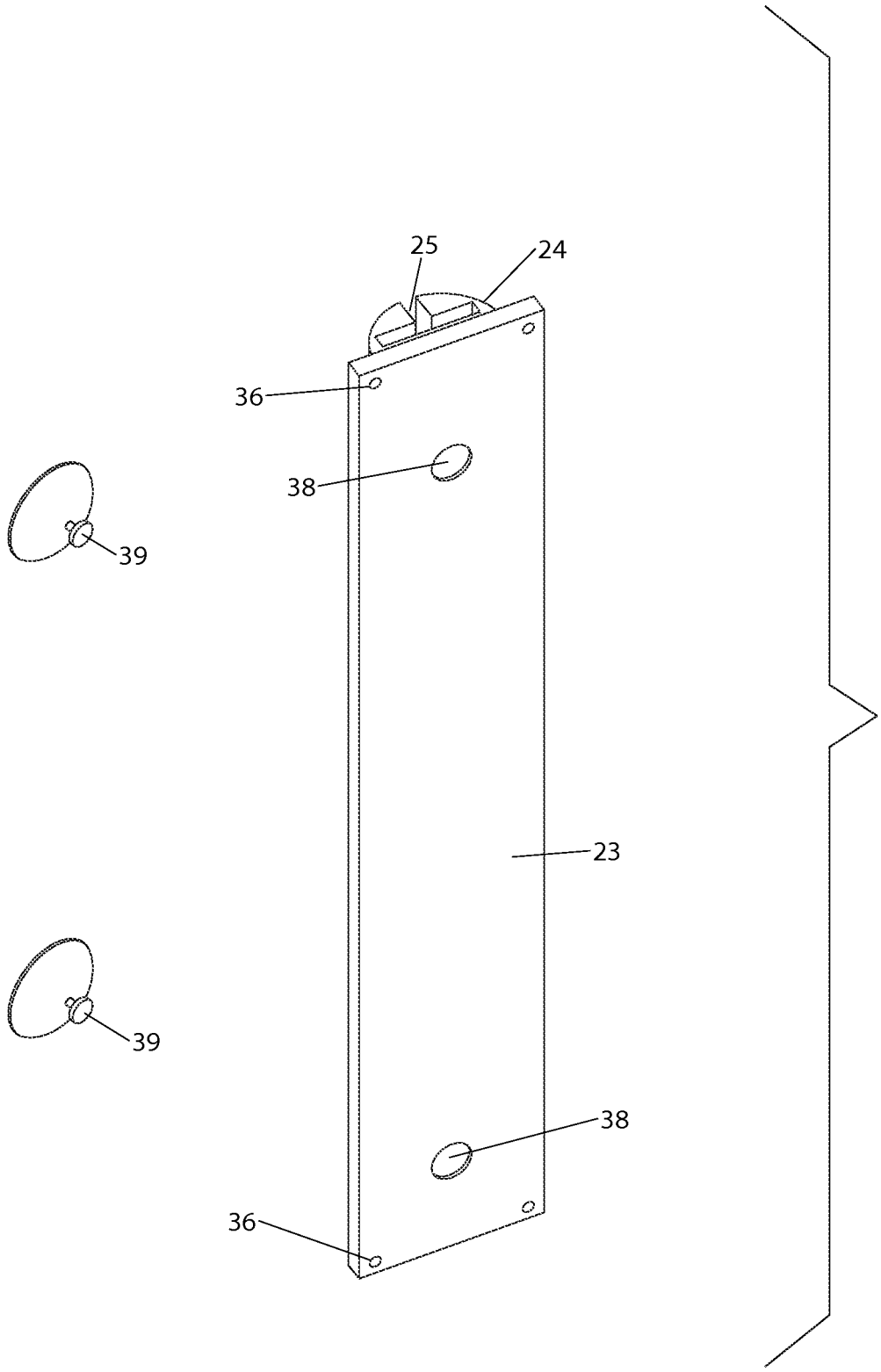
FIG. 4 is a perspective view of a mounting bracket and suction cup of the shower-mounted back scrubber in accordance with FIG. 2; and, FIG. 5 is a perspective view of a mounting bracket and suction cup of the alternate embodiment of the shower-mounted back scrubber in accordance with FIG. 3.
Figure 5:
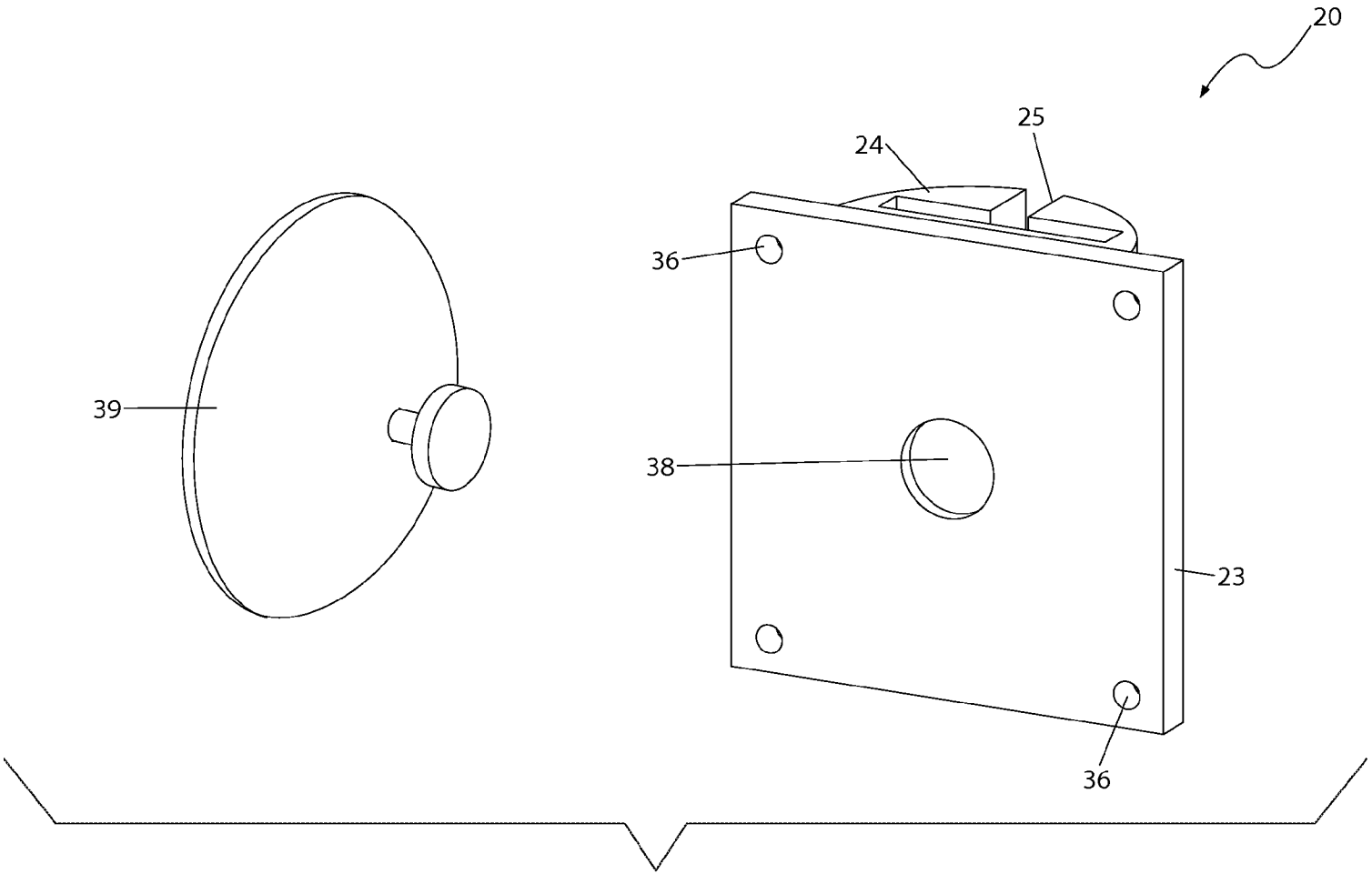

In accordance with the invention, the best mode is presented in terms of a preferred embodiment, herein depicted within FIGS. 1, 2, and 4, and in terms of an alternate embodiment, herein depicted within FIGS. 3 and 5. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 5, depicting a shower-mounted back scrubber (herein described as a "device") 10, where like reference numerals represent similar or like parts. In accordance with the invention, the present disclosure describes a device 10 for washing, exfoliating, and scratching of a bather's back area, and as such will be discussed with reference to FIGS. 1 through 5.

Referring to FIG. 1, the device 10 generally includes at least one mounting bracket 20 generally installed or attached to a shower wall 100. A brush base 21 is removably coupled to the mounting bracket 20. A brush surface 22 is disposed upon at least an outwardly facing surface of the brush base 21. The mounting bracket 20 is preferably installed in vertical alignment, such that the brush base 21 and brush surface 22 are maintained in a generally vertical orientation. The mounting bracket 20 includes a mounting plate 23 and a mounting tab 24 extending outwardly from the mounting plate 23. The mounting tab 24 includes a mounting slot 25 for receiving the brush base 21. The device 10 is preferably approximately sixteen inches (16 in.) long and extends outwardly approximately one to two inches (1-2 in.) when installed.

Referring to FIG. 2, illustrating one embodiment of the device 10 having a single elongated mounting bracket 20 and an elongated mounting tab 24. The mounting slot 25 extends the length of the mounting tab 24 and has a generally "T"-shaped profile. The mounting slot 25 includes an open top 26 of the mounting tab 24 and terminates at a closed bottom 28. The closed bottom 28 acts as a stopper and position restraint for the brush base 21.

Referring still to the embodiment illustrated in FIG. 2, the brush base 21 includes an elongated and generally semi-circular base rod 29. A generally "T"-shaped protrusion 30 extends outwardly along an entire flat rear surface of the base rod 29. Once the mounting bracket 20 is installed, the brush base 21 is attached by sliding the protrusion 30 entirely through the mounting slot 25. The closed bottom 28 of the mounting slot 25 stops the brush base 21 and maintains it in a stationary vertical position.

Referring still to the embodiment illustrated in FIG. 2, the brush surface 22 is disposed entirely along the curved outer surface of the base rod 29. The brush surface 22 includes a plurality of bristles 31 affixed to the base rod 29. The brush surface 22 can be a flexible and flat brush pad having a plurality of affixed bristles 31 which is adhered or otherwise affixed to the surface of the base rod 29. Alternatively, the plurality of bristles 31 can be affixed in clusters or bundles to the entire curved surface of the base rod 29. The plurality of bristles 31 can include soft bristles, course bristles, or a combination thereof intended to both clean and exfoliate the bather's skin.

Referring to FIG. 3, illustrating another embodiment of the device 10 having a pair of mounting brackets 20, i.e., a top mounting bracket 20*a* and a bottom mounting bracket 20*b*. Each mounting bracket 20*a*, 20*b* includes the mounting tab 24 extending from the front surface of the mounting plate 23. The mounting slots 25 of each mounting tab 24 have a generally semi-circular profile. A top mounting slot 25*a* extends entirely though the mounting tab 24 of the top mounting bracket 20*a* having an open top 26 and an open bottom 27. The bottom mounting slot 25*b* extends almost entirely though the mounting tab 24 of the bottom mounting bracket 20*b* having an open top 26 and a closed bottom 28. During installation, the top mounting bracket 20*a* and the bottom mounting bracket 20*b* are used and attached to the shower wall 100 in vertical alignment.

Referring still to the embodiment illustrated in FIG. 3, the brush base 21 includes an elongated and generally circular base rod 29. The base rod 29 includes a generally semi-circular top end portion 32 and a generally semi-circular bottom end portion 33. Once the mounting brackets 25 are installed, the brush base 21 is attached by sliding it entirely through the top mounting slot 25*a* and within the bottom mounting slot 25*b*. The closed bottom 28 of the bottom mounting slot 25*b* stops the brush base 21 and maintains it in a stationary vertical position. The top and bottom mounting brackets 20*a*, 20*b* are installed to the shower wall 100 in a spaced apart orientation at a distance approximately equivalent to the length of the brush base 21 and suitable to retain the opposing top end portion 32 and the bottom end portion 33 of the base rod 29.

Referring still to the embodiment illustrated in FIG. 3, the brush surface 22 is disposed entirely along the outer surface of the circular middle portion 34 of the base rod 29. The brush surface 22 includes a plurality of bristles 31 removably attached to the base rod 29. The brush surface 22 is preferably a tubular brush pad 40 having a plurality of affixed bristles 31. The brush base 21 is inserted entirely through the tubular brush surface 22 such that the top end portion 32 and the bottom end portion 33 are exposed. The brush pad 40 can be rotated around the middle portion 34 of the base rod 29 after certain areas of bristles 31 are worn. The brush base 21 does not rotate within the mounting slots 25 due to the semi-circular mating engagement of the end portions 32, 33 of the base rod 29 and the mounting slots 25*a*, 25*b*. The plurality of bristles 31 can include soft bristles, course bristles, or a combination thereof intended to both clean and exfoliate the bather's skin.

Referring still to the embodiment illustrated in FIG. 3, the top mounting bracket 20*a* can also include a pivotably attached slot cover 35. The slot cover 35 is a generally thin and flat member pivotably attached to an upper, rear surface of the mounting tab 24 by a fastener. The slot cover 35 is rotated to one side or the other to provide access to the top mounting slot 25*a* when inserting or removing the brush base 21.

Referring to FIGS. 4 and 5, each mounting bracket 20 includes a plurality of means for attaching or otherwise installing the mounting brackets 20 to the shower wall 100. A plurality of fastener apertures 36 is disposed through the mounting plate 23, preferably at corner locations. The mounting brackets 20 can be fastened to the shower wall 100 by a plurality of fasteners. A rear surface 37 of the mounting plate 23 also includes at least one suction cup aperture 38 for removably receiving an insertable end of a suction cup 39. Once the one (1) or more suction cups 39 are attached to the mounting bracket 20, the suction cup 39 can be attached to the surface of the shower wall 100. Furthermore, the rear surface 37 of the mounting plate 23 can be attached to the shower wall 100 by an adhesive, double faced tape, or similar chemical fastener. As best seen in FIG. 4, the single elongated bracket 20 includes a pair or more of suction cup apertures 38 for receiving a pair of suction cups 39. As best seen in FIG. 5, the top and bottom mounting brackets 20*a*, 20*b* each include a single suction cup aperture 38 for receiving a suction cups 39.

The materials required to produce the device 10 are all readily available and well known to manufacturers of goods of this type. The mounting brackets 20 and brush base 21, to which the brush surface 22 is applied, can be made of stainless steel, aluminum, or plastic depending upon cost parameters. Such processes would require the design and use of custom dies and molds. The suction cups 39, brush surface 22, bristles 31, any fasteners, and the like, would best be procured from wholesalers and manufacturers that deal in goods of that nature and assembled at a final location.

It can be appreciated by one skilled in the art that other styles and configurations of the present invention can be easily incorporated into the teachings of the present disclosure and only two particular configurations have been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it is installed and utilized as indicated in FIGS. 1 through 4.

The method of installing and utilizing the device 10 can be achieved by performing a series of steps. It can be appreciated that the steps described can be performed in alternative order and as such should not be viewed as a limiting factor.

To install the device 10, the bracket 20 is mounted to a selected surface of the shower wall 100. The bracket 20 is positioned at a suitable height to align with the back area of the bather for receiving the brush body 21. The manner in which the mounting bracket 20 is attached to the shower wall 100 depends upon the surface material and the permanence desired by the user. Once the mounting brackets 20 is attached to the shower wall 100, the brush base 21 is coupled to thereto by sliding the protrusion 30 though the mounting slot 25.

To install the alternate embodiment of device 10 as depicted in FIGS. 3 and 5, a pair of brackets 20 is mounted to a selected surface of the shower wall 100. The top and bottom mounting brackets 20*a*, 20*b* are positioned at a suitable height to align with the back area of the bather and are spaced apart in a vertical alignment for receiving the brush body 21. The manner in which the mounting brackets 20 are attached to the shower wall 100 depends upon the surface material and the permanence desired by the user. Once the top and bottom mounting brackets 20*a*, 20*b* are attached to the shower wall 100, the brush base 21 is coupled to thereto by sliding the base rob 29 though the top mounting slot 25*a* and into the bottom mounting slot 25*b*.

To use the device 10, soap is applied to the installed brush surface 22. Then the user slides their back area in an upward and downward and side-to-side manner across the brush surface 22 to scrub, clean, and exfoliate their back area. When finished, the device 10 is rinsed. The brush base 21 and brush surface 22, as depicted in FIG. 2, can be replaced when worn. The brush surface 22, as depicted in FIG. 3, can be removed and disposed of when worn and a new brush surface 22 can be applied to the brush base 21.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A shower-mountable back scrubber device comprising:

a mounting bracket adapted for attaching to a shower wall surface, said mounting bracket comprising:

an elongated and generally flat mounting plate;

a mounting tab extending outwardly from and along an entire front side surface of said mounting plate, said mounting tab comprising a first end and a longitudinally opposed second end; and, a "T"-shaped mounting slot extending longitudinally through said mounting tab from said first end to proximate said second end such that said first end is open and said second end is closed;

an elongated base rod comprising a generally semi-circular cross-sectional shape, said base rod comprising a first end, a second end longitudinally opposed from said first end;

a "T"-shaped protrusion extending longitudinally from said first end to said second end of said base rod, said protrusion slidably connected within said mounting slot and extending from said closed second end to said open first end of said mounting slot, wherein said closed second end limits longitudinal movement of said protrusion within said mounting slot; and, a plurality of bristles affixed said base rod and adapted for scrubbing the skin of a bather when in moving contact with said bristles.

2. The device of claim 1, wherein said mounting bracket comprises at least one suction cup aperture disposed in a rear side surface of said mounting plate for removably receiving at least one suction cup.

3. The device of claim 1, wherein said mounting bracket comprises a plurality of fastener apertures disposed through said mounting plate adapted for receiving a plurality of fasteners.

4. The device of claim 1, wherein said base rod comprises a flat rear surface, and wherein said protrusion extends outwardly from said flat rear surface.

5. The device of claim 1, wherein said base rod comprises a curved front surface, and wherein said plurality of bristles are affixed to an entirety of said curved front surface of said base rod.

* * * * *